US009764890B2

(12) United States Patent
Gillespie et al.

(10) Patent No.: US 9,764,890 B2
(45) Date of Patent: Sep. 19, 2017

(54) LIQUID SPRAY DISPENSER SYSTEM

(71) Applicant: Vega Innovations Pty Ltd, Milton (AU)

(72) Inventors: Benjamin Cyril Gillespie, Kangaroo Point (AU); David Eric Griffin, Annandale (AU)

(73) Assignee: VEGA INNOVATIONS PTY LTD (AU)

( * ) Notice: Subject to any disclaimer, the term of this patent is extended or adjusted under 35 U.S.C. 154(b) by 0 days.

(21) Appl. No.: 14/772,415

(22) PCT Filed: Mar. 4, 2014

(86) PCT No.: PCT/AU2014/000199
§ 371 (c)(1),
(2) Date: Sep. 3, 2015

(87) PCT Pub. No.: WO2014/134665
PCT Pub. Date: Sep. 12, 2014

(65) Prior Publication Data

US 2016/0009480 A1 Jan. 14, 2016

(30) Foreign Application Priority Data

Mar. 4, 2013 (AU) ..... 2013900756

(51) Int. Cl.
*B67D 1/10* (2006.01)
*B67D 7/14* (2010.01)
(Continued)

(52) U.S. Cl.
CPC ..... *B65D 83/38* (2013.01); *B05B 9/0838* (2013.01); *B65D 83/0011* (2013.01);
(Continued)

(58) Field of Classification Search
CPC .... B65D 83/38; B65D 83/0011; B65D 83/16; B65D 83/28; B65D 83/62; B65D 83/0055; B65D 83/0072; B05B 9/0838
(Continued)

(56) References Cited

U.S. PATENT DOCUMENTS 1,235,550 A * 8/1917 Carmody ..... B65D 83/62 169/33
3,335,913 A * 8/1967 Bouet ..... B05B 9/0838 222/95
(Continued)

FOREIGN PATENT DOCUMENTS

EP 0503031 B1 4/1998
WO 2011065903 A1 6/2011

*Primary Examiner* — J. Casimer Jacyna
*Assistant Examiner* — Benjamin R Shaw
(74) *Attorney, Agent, or Firm* — Dureska & Moore, LLC; David P. Dureska; Brent L. Moore

(57) ABSTRACT

A liquid spray dispensing system has a liquid container receivable within a housing, provided in separable housing portions. The liquid container has at least one flexible side or end wall or a slidable end wall, movable by an actuator, to reduce the volume of a liquid storage compartment containing the liquid to be dispensed through a spray nozzle unit operably connected to the liquid storage compartment. By operating the spray nozzle unit, or a switch operably connected to a spray actuator of the spray nozzle unit, the actuator moves the flexible or slidable wall to reduce the volume of the liquid storage compartment, and thereby cause the pressurized liquid to be dispensed through the spray nozzle unit.

18 Claims, 3 Drawing Sheets

(51) Int. Cl.

| | |
|---|---|
| ***B65D 83/38*** | (2006.01) |
| ***B65D 83/16*** | (2006.01) |
| ***B65D 83/28*** | (2006.01) |
| ***B65D 83/62*** | (2006.01) |
| ***B65D 83/00*** | (2006.01) |
| ***B05B 9/08*** | (2006.01) |

(52) U.S. Cl.
CPC ..... *B65D 83/16* (2013.01); *B65D 83/28* (2013.01); *B65D 83/62* (2013.01)

(58) Field of Classification Search
USPC ..... 222/61, 390, 326
See application file for complete search history.

(56) References Cited

U.S. PATENT DOCUMENTS 3,951,310 A * 4/1976 Steiman ..... B05B 9/0838 222/340
4,067,499 A * 1/1978 Cohen ..... A61F 9/0008 222/105
5,027,984 A * 7/1991 Gakhar ..... B05C 17/0103 222/326
5,238,150 A * 8/1993 Williams ..... B05B 9/0838 222/105
5,353,962 A * 10/1994 Scholz ..... B05B 9/0838 222/105
5,685,456 A * 11/1997 Goldstein ..... B05B 9/0838 222/340
5,762,239 A * 6/1998 Cossette ..... B05C 17/0103 222/326
6,488,180 B1 * 12/2002 Bayat ..... B05C 17/00553 222/137
8,550,300 B2 * 10/2013 Lee ..... B05B 11/0021 222/105
2005/0145722 A1 * 7/2005 Wang ..... B05B 9/0838 239/323
2006/0255066 A1 * 11/2006 Kannar ..... A23G 9/045 222/145.3
2009/0028629 A1 * 1/2009 deVirag ..... B65D 83/0011 401/266
2012/0111894 A1 * 5/2012 Bakhos ..... B65D 47/2018 222/209
2013/0047981 A1 * 2/2013 Bacon ..... B01F 13/002 128/200.23
2014/0183222 A1 * 7/2014 Morrison ..... B05B 9/0811 222/95
2014/0376986 A1 * 12/2014 Arwatz ..... A45D 34/04 401/101
2016/0151803 A1 * 6/2016 Arwatz ..... B05C 17/0103 401/172

* cited by examiner

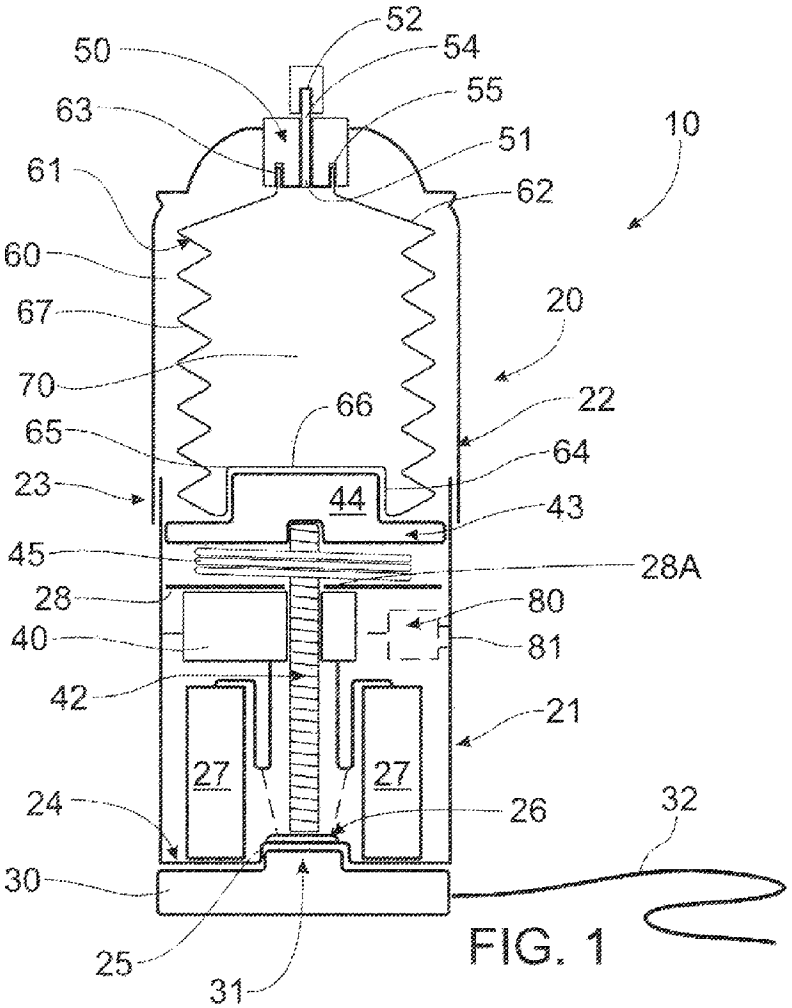
FIG. 1
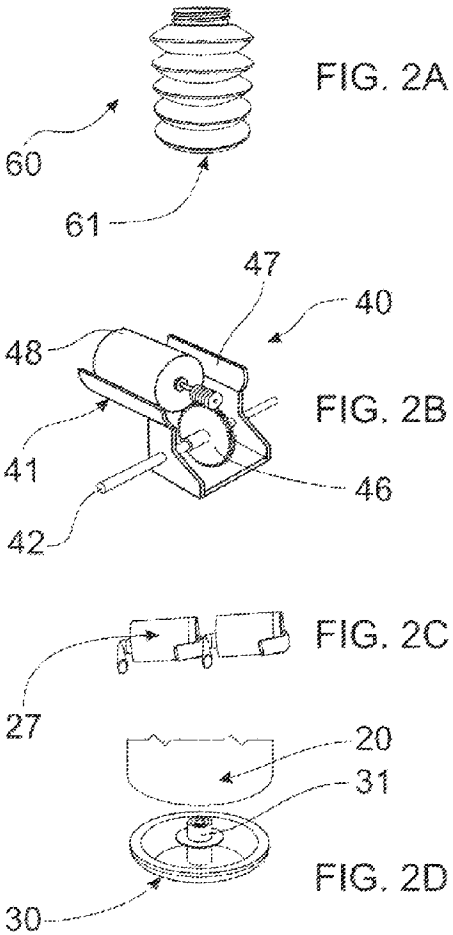
FIG. 2A
FIG. 2B
FIG. 2C
FIG. 2D

LIQUID SPRAY DISPENSER SYSTEM

CROSS-REFERENCE TO RELATED APPLICATIONS

This application claims the benefit of PCT Application Serial No. PCT/AU2014/000199, filed Mar. 4, 2014, which in turn claims the benefit of Australian Patent Application Serial No. 2013900756, filed Mar. 4, 2013.

BACKGROUND OF THE INVENTION

1. Field of the Invention

This invention relates to a liquid spray dispenser system.

The invention particularly relates, but is not limited to, a liquid spray dispenser system operable to continuously, or periodically, dispense at least one liquid from a replaceable and/or rechargeable non-pressurised (or partially-pressurised) container.

The invention also relates to a container for liquid for use with the liquid spray dispenser system.

The container may contain a wide range of liquids to be dispensed as an aerosol spray, including: paints, coatings, inks, adhesives, insecticides, pesticides, herbicides, lubricants, anti-corrosion chemicals, room-freshening scents or the like. The contents of the container may be at least partially-pressurised by suitable propellant gas (or gasses), including hydrocarbons, or gas (or gasses) inert to the liquids, dissolved therein.

2. Prior Art

NB: The following discussion is by way of background information only, and is not to be considered a statement of the common general knowledge (CGK) in the area of technology.

Many spray actuators for pressurised aerosol containers have been proposed, or adopted, over the years.

In the simplest versions, a simple "valve actuator" is fitted to a valve stem in communication with the interior of the container, and is provided with a nozzle, arranged to produce a cone-like spray pattern. When the valve stem is operated e.g. depressed by the valve actuator, the stem causes the valve in the container to release a portion of the liquid contents (and propellant) from the container, to be released in the spray pattern from the nozzle.

Over the years, more complex spray actuators have been devised. In particular, the actuators may comprise a body (mountable on the container), a nozzle, and a trigger hingedly mounted on/on the body, and the nozzle communicates with the interior of the container via a product passageway connected to a valve in the container and an orifice in the nozzle.

Examples of recent designs of such spray actuators are disclosed in WO 2007/021918 A1 (Summit Packaging Systems, Inc) (=U.S. Pat. No. 7,204,393) (Strand)) and US 2010/0059551 A1 (Tomkins et al).

To improve the efficiency of the dispensing of the liquid contents, such as insecticides and room fresheners; or the periodic dispensing of lubricants or anti-corrosion chemicals onto adjacent equipment; dispenser systems have been developed. Typically, an aerosol container, e.g. containing an insecticide to kill flying/crawling insects, is received in a housing of the dispenser system; and may be enclosed by a hinged- or sliding cover or door. The nozzle on the valve stem of the aerosol container, or the valve stem itself, is engaged by an actuator in the housing. The actuator is typically electrically-powered, from batteries and/or a mains supply; and the actuator typically has a timer, or other control unit, which causes the actuator to be cyclically operated e.g. every 10/20/30/60/120 minutes, or similar; for a predetermined operating period e.g. 0.5/1/2/5/10/20 seconds or similar. In many such systems, the operation time(s) will be determined if the system is located internally or externally of an at least partially-enclosed space e.g. a verandah, garage, car-port or shade-structure.

The aerosol containers must be replaced periodically, as the dispensing system is of little, if any, utility when all the liquid in the aerosol container has been dispensed (and only the propellant gas or gasses are being released therefrom).

OBJECTS OF THE INVENTION

It is a preferred object of the present invention to overcome, or at least ameliorate, the problems with known liquid spray dispensing systems.

It another preferred object to provide a container for use with the liquid spray dispensing system.

Other preferred objects of the present invention will become apparent from the following description.

SUMMARY OF THE PRESENT INVENTION

In one form, although not necessarily the only or broadest form, the present invention resides in a liquid spray dispensing system, including:

a housing;

a liquid container, receivable in the housing, operable to contain at least one liquid to be dispensed, and having a liquid storage compartment with at least one flexible or movable wall portion;

a spray nozzle unit at, or adjacent, a first end of the housing, the spray nozzle unit, connectable to the liquid storage compartment, having a spray outlet ; and an actuator in the housing, the actuator being operably engageable with the flexible or movable wall portion to reduce the volume of the liquid storage compartment, so as to enable at least a portion of the liquid within the liquid storage compartment to be dispensed through the spray nozzle unit.

Preferably, the housing is formed in two (or more) portions, where a first (preferably, lower) housing portion is supportable or mountable on a surface; and a second (preferably, upper) housing portion is detachably-mounted, hingedly mounted or movably mounted on the first housing portion to enable access to at least one compartment within the housing.

Preferably, the second housing portion may be detachably coupled to the first housing portion via a bayonet-type coupling, a screw-type coupling, a friction-coupling, or other suitable releasable connection.

Preferably, the liquid container is substantially cylindrical in configuration, with at least one side wall, a first (e.g. upper) end wall, and a second (e.g. lower) end wall; and where the fluid outlet is connected to the first end wall.

Alternatively, the liquid container is substantially spherical; and the fluid outlet is connected to the spherical side wall.

Preferably, at least the side wall is formed of flexible material, such as rubber—or plastic-material; and the side wall may have one or more flex—or fold-lines e.g. so that the side wall is of substantially concertina-like configuration.

Preferably, the second end wall, or a portion of the spherical side wall, has a substantially-planar portion to be engaged by the actuator; and the planar portion may be recessed relative to the surrounding portion(s) of the second end wall or spherical side wall.

Preferably, the spray nozzle unit extends through an end wall of second housing portion; with the inlet within the second housing portion, with the liquid outlet connected to the spray nozzle unit at or adjacent the inlet; and the outlet is external to the second housing portion.

Preferably, the spray nozzle unit is operable to dispense the liquid while the actuator is in operation. The spray nozzle unit may have a pressure-sensitive (or -limiting valve) which releases the liquid through the outlet when the pressure of the liquid reaches/exceeds a preset limit. Alternatively, the spray nozzle unit may be electrically-operated to dispense the liquid while the actuator is in operation.

Preferably, the actuator is mounted in the first housing portion and has an actuator plate or piston reciprocally-movable along a path substantially co-axial with a longitudinal axis of the housing, the plate or piston engaging the second end wall or spherical side wall to move that wall towards the liquid outlet to reduce the volume of the liquid storage compartment.

Preferably, the actuator plate or piston is mounted on a shaft of an electronic worm drive unit. Alternatively, the actuator plate or piston is mounted on a rack of a rack-and-pinion drive unit.

Alternatively, the actuator is a linear actuator, which may be connected to an electric motor or electric drive.

Preferably, the actuator is powered by (preferably rechargeable) batteries in the first housing portion and/or a mains-electricity supply, via a recharging base or station fixed to, or releasably detachable from, a bottom wall of the first housing portion.

Preferably, a constant pressure spring applies a substantially constant pressure force on the actuator plate or piston, urging the actuator plate or piston into engagement with the liquid storage compartment to at least partially pressurise the liquid before the latter is dispensed.

Alternatively, a pressure sensor in, or on, the liquid storage compartment may operate to actuator to pressurize the liquid to a preset pressure.

Other preferred features of the present invention will become apparent from the following description.

BRIEF DESCRIPTION OF THE DRAWINGS

To enable the invention to be fully understood, and to enable the skilled addressee to put the invention into practice, a number of preferred embodiments will now be described, with reference to the accompanying illustrations, in which:

FIG. 1 is a schematic sectional side view of a first embodiment of a liquid spray dispensing system in accordance with the present invention;

FIGS. 2A-2D illustrate examples of components of the dispensing system of FIG. 1;

Figure 4:
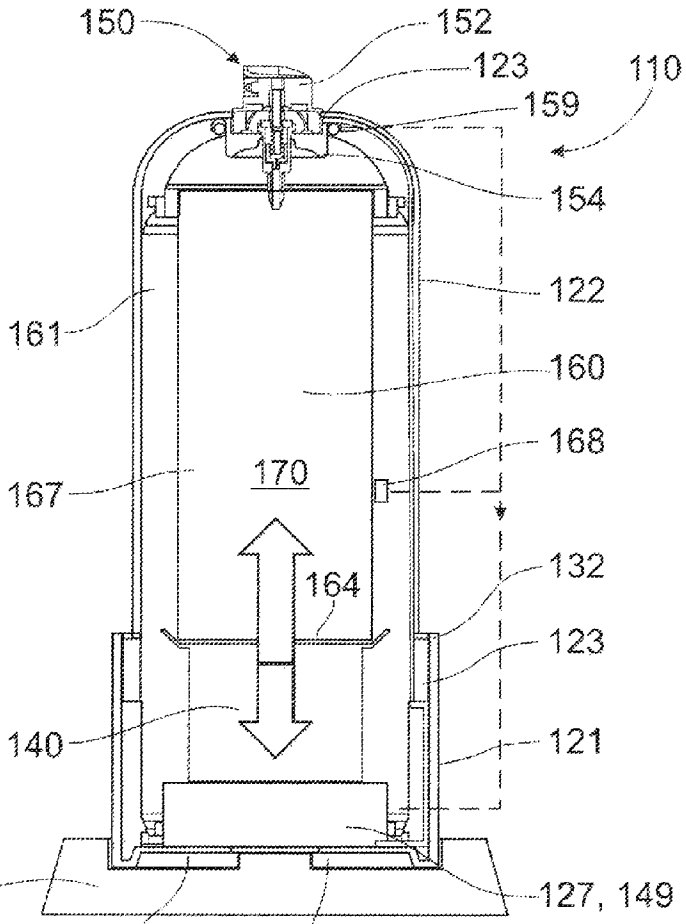
FIG. 4 is a schematic sectional side view of the dispensing system of FIG. 2.

NB: Any notations, comments, dimensions, volumes, ranges, percentages, trade marks, labels or other material on the FIGS. are by way of illustration only, and are not limiting to the scope of the present invention.

DETAILED DESCRIPTION OF THE PREFERRED EMBODIMENTS

FIGS. 1 and 2A to 2D illustrate a first preferred embodiment of the liquid spray dispensing system 10 of the present invention, where the liquid to be dispensed is stored on a bottle, or other liquid storage compartment, within a second (or upper) housing portion releasably detachable from a first (or lower) housing portion containing the actuator, the first housing portion being supported on a table or other surface, or mountable on a building wall or other support, not shown.

The (liquid spray) dispensing system 10 has a hollow (preferably substantially-cylindrical) housing 20, with a first (or lower) housing portion 21 and a second (or upper) housing portion 22 interconnected by a bayonet- or screw-type coupling 23.

The bottom wall 24 of the first housing portion 21 has a central recess 25 engaged by a spigot 31 of a recharging unit 30, having an electrical cord 32 connected to a mains-electricity supply (not shown). The spigot 31 has electrical contacts (not shown) operably connectable to complementary electrical contacts, also not shown, in an electrical connector 26 in the bottom wall 24.

A pair of rechargeable batteries 27 are provided in the first housing portion 21 and are operably connected to the electrical connector 26.

Annular mounting plate 28 is provided in the first housing portion 21, with a central hole 28A.

An electrically-powered worm-drive actuator 40 has an actuator body 41 mounted on the underside of the mounting plate 28; and has a worm shaft 42 (extending through the hole 28A) co-axial with the central axis of the housing 20. Referring to FIG. 2B, the worm shaft 42 is engaged by a screw-threaded driving ring 46, rotatably mounted in the actuator body 41, and reversibly driven by a pinion gear 48 connected to a reversible electric motor 49, to cause the worm shaft 42 to be raised, or lowered, relative to the mounting plate 28 and actuator body 41.

A circular actuator piston 43 is rotatably mounted at the upper end of the worm shaft 42 and has an upper spigot portion 44.

A constant pressure coil spring 45 is interposed between the mounting plate 28 and the underside of the actuator piston 43 to urge the latter in an upward direction.

An electronically-controlled spray nozzle unit 50 is mounted centrally in the top wall 29 of the second housing portion 22, co-axial with the worm shaft 42.

The spray nozzle unit 50 has an inlet 51 (within the second housing unit 22), and an outlet 52 (externally of the second housing unit 22), interconnected by a product passageway 54. An annular slot 55 is provided in the lower face of the spray nozzle unit 50, around the inlet 51.

A liquid storage compartment 60, in the form of a plastic-material bottle 61, contains the liquid 70 (e.g. an insecticide) to be dispensed.

The bottle 61 may be blow-moulded from e.g. PET (or other suitable plastics-material); and has a frusto-conical top wall 62 with a liquid outlet (or mouth) 63 sealably received in the annular slot 55 in the spray nozzle unit 50. The bottle has a bottom wall 64 with a central recess 65 (with a planar wall portion 66), which receives the upper spigot portion 44 of the actuator piston 43.

The top and bottom walls 62, 64 of the bottle 61 are interconnected by a flexible side wall 67, which has a concertina-like configuration, to allow the bottle to "collapse" as the actuator piston 43 is moved upwardly to reduce the volume of the liquid 70 in the bottle 61.

While the constant pressure coil spring 45, operating on the actuator piston 43, seeks to at least partially-pressurise the liquid 70 in the bottle 61, propellant gas may be provided in the bottle 61 to assist the pressurization of the liquid 70; or the spring 45 may be omitted and the liquid 70 can be solely pressurised by propellant gas in the bottle 61.

A timer unit 80, with an "On-Off" switch (and optional time selector) 81, is connected to the actuator 40 (and, optionally, to the spray nozzle unit 50).

The operation of the dispensing system 10 will now be described.

The dispensing system 10 is assembled as illustrated in FIG. 1, with the bottle 61 full of liquid 70, and the actuator piston 43 in its fully lowered (i.e. retracted) position.

The operator operates the switch 81 to activate the timer unit 80.

The timer unit 80 periodically operates the actuator 40 (and spray nozzle unit 50) for a preselected period. For example, the timer unit 80 may operate the actuator 40 (and spray nozzle unit 50) for a 5 second operating period at a cyclic interval of every 20 minutes. (The skilled addressee will appreciate both the operating period and cycling period will be preferably adjustable, and be adjusted, to suit the particular application for the dispensing system.)

When the actuator 40 is operated, the screw-threaded driving ring will rotate to urge the worm shaft 42 upwardly, and the actuator piston 43 will raise the bottom wall 44 to compress the liquid 70 in the bottle 61.

The spray nozzle unit 50 will operate e.g. either controlled by the timer unit 80, or a pressure-sensitive valve in the product passageway 54, to connect the inlet 51 to the outlet 52 to enable the liquid 70 to be dispensed from the outlet 52 (or from any nozzle or tube fitted thereto), until the actuator 40 is switched off.

When, or before, all the liquid 70 has been dispensed from the bottle 61, the coupling 23 between the first and second housing portions 21, 22 is released and the second housing portion 22 (with the exhausted bottle 61) is removed. The actuator 40 is reset with the actuator piston 43 in the lower (or retracted) position; and another second housing portion 22, with a bottle 61 full of liquid 70, is connected to the firs housing portion 21.

The dispensing system 50 is ready to recommence operations.

The recharging unit 30 recharges the batteries 27 and/or can directly power the actuator 40 from the mains-supply.

The coupling 23 between the first and second housing portions 21, 22 may be of the bayonet-coupling type; screw-coupling type; frictional-coupling type; or other suitable releasable coupling.

As hereinbefore described, the worm drive actuator 40 can be substituted by a rack-and-pinion actuator or other suitable linear actuator.

In an alternative embodiment of the liquid storage compartment 60, the compartment 60 may have a flexible wall portion engaged by the actuator piston 43, where the flexible wall portion is urged into the interior of the liquid storage compartment 60 to cause the liquid 70 to be dispensed therefrom.

In the preferred embodiment hereinbefore described, the second housing portion 22, and bottle 61, is released from the first housing portion 21 to enable the dispensing system 10 to be "recharged" with the liquid to be dispensed. In an alternative embodiment (not illustrated), which may be more suitable for commercial- or semi-commercial applications e.g. where the volume of liquid 70 in the bottle 61 is much larger, the housing 20 may be releasably mountable on the recharging unit 30, and the whole housing 20 is released therefrom and replaced by a similar housing 20 with a bottle 61 full of liquid 70. The whole housing 20 is returned to a supplier for refilling of the bottle 61 for re-use.

In alternative embodiments, not illustrated, the skilled addressee will appreciate that straws, tubes or other nozzle extensions may be sealably connected to, or formed integrally with, the outlet 52 of the spray nozzle unit 50, where the liquid 70 is to be dispensed e.g. a small distance remote from the housing of the dispensing system e.g. to lubricate rotating or reciprocating equipment.

Also, as hereinbefore described, the product passageway 54 interconnecting the inlet 51 to the outlet 52, may be provided with a pressure-sensitive valve which permits the liquid 70 to be dispensed through the outlet 52 when the pressure within the bottle 61 reaches/exceeds a preset limit, and which can act as a pressure-release safety valve e.g. when ambient temperatures cause the pressure within the bottle 61 to reach unsafe levels.

Figure 3:
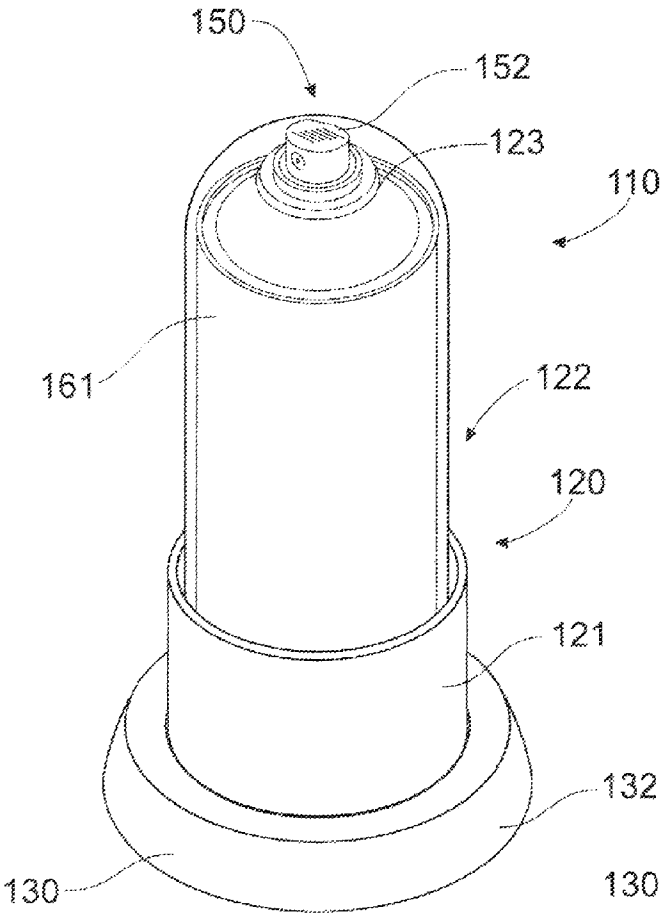
FIG. 3 is a top view of a second embodiment of a liquid spray dispensing system in accordance with the present invention.

FIGS. 3 and 4 illustrate a second embodiment of the liquid spray dispensing system 110 of the present invention, where the liquid to be dispensed is stored in a non- or partially-pressurised container received in a housing supported on a re charging base or station.

The dispensing system 110 has a two-part housing 120, with a lower housing portion 121 and an upper housing portion 122, formed of transparent or semi-opaque plastics material, interconnected by a releasable coupling 123 as hereinbefore described.

The lower housing portion 121 is receivable within a recharging base station 130 with electrical contacts 131, surrounded by a peripheral wall 132.

An electric motor 149 and rechargeable batteries 127 are provided in the lower housing portion 121, and are operably connected to electrical contacts 126 which can operably engage the electrical contacts 131 in the base station 130. The electric motor 149 has an extendable/retractable plunger or actuator 140.

A spray nozzle unit 150 extends through a hole 123 in the upper housing portion and has a spraying outlet 152 external to the upper housing portion. An inlet to the spray nozzle unit 150 is connected to the liquid storage compartment 160 of a container 161, which contains the liquid 170 to be dispensed. The liquid storage compartment 160 may have a flexible side wall 167 and a bottom wall 164 engaged by the actuator 140; or the bottom wall 164 may be sealably/slidaby received within the a rigid side wall 167; to allow the volume of the liquid storage compartment 160 to be reduced by extension of the actuator 140 by the electric motor 149.

As indicated by dashed lines in FIG. 4, the spray actuator 152 of the spray nozzle unit 150 is operably connected to the electric motor 149 e.g. by a pressure- or motion-sensor 159 which detects downward movement of the spray actuator 152, when opening the valve 154 of the spray nozzle unit 150 to allow dispensing of the liquid 170, that movement causing a signal to be sent to the electric motor 149 to extend the actuator 140 to maintain at least a minimum pressure within the liquid storage compartment 160. (A pressure-sensor 168 in, or connected to, the liquid storage compartment 160, may switch off the electric motor 149 to prevent over-pressurization of the liquid storage compartment 160 and/or operate the electric motor 149 to maintain a minimum preset pressure in the liquid storage compartment 160.)

The skilled addressee will appreciate that depressing the spray actuator 152 opens the valve 154 to enable the liquid to be dispensed from the spray nozzle unit 150, while simultaneously causing the electric motor 149 to extend the actuator 140 against the bottom wall 167 of the liquid storage compartment to maintain the liquid 170 therein within a preselected pressure range.

When all the liquid 170 has been dispensed, the upper housing portion 122 is released from the lower housing portion 121, via the releasable coupling 123; the liquid storage container 161 is removed; the electric motor 149 operated to retract the actuator 140; a replacement container 161 is located within the lower housing portion 121; and the upper housing portion 122 is refitted. The pressure sensor 168, if provided, may operate the electric motor 149 so that the actuator 140 is extended until the liquid 170 is raised to a preset minimum pressure for dispensing.

Figure 6:
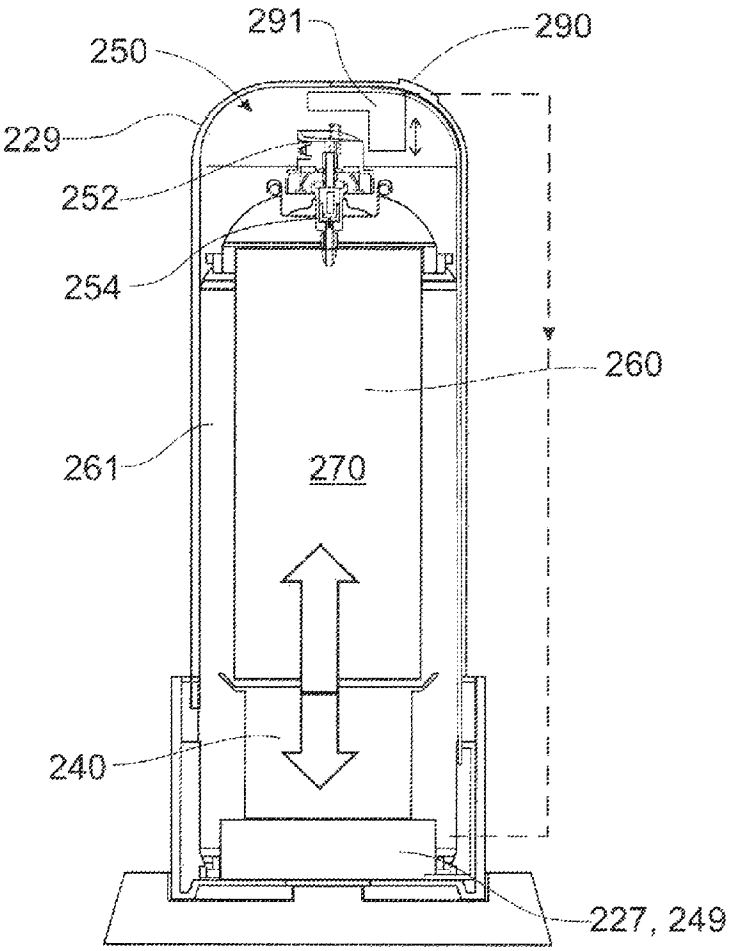
FIG. 6 is a schematic sectional side view of the dispensing system of FIG. 5.
Figure 5:
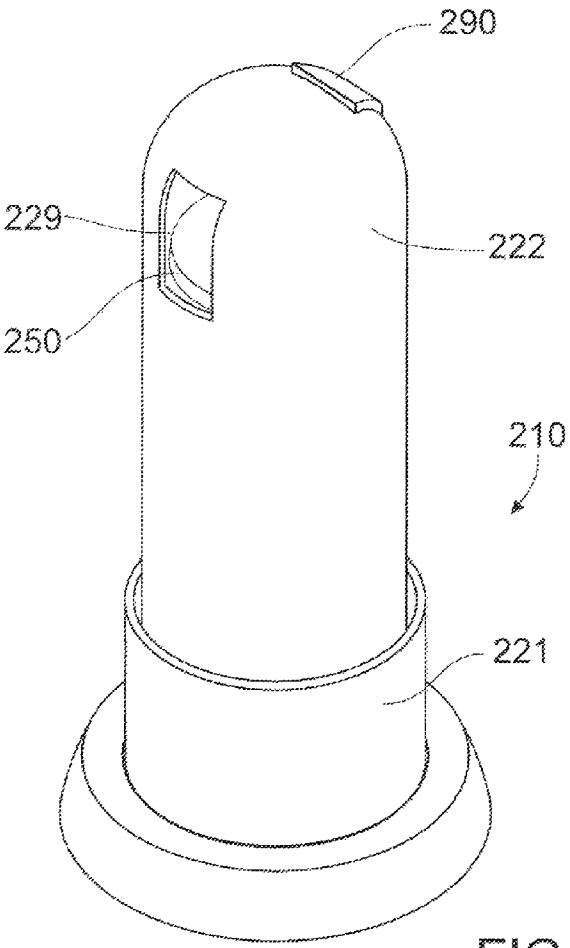
FIG. 5 is a top view of a third embodiment of a liquid spray dispensing system in accordance with the present invention.

The third embodiment of the dispensing system 210, illustrated in FIGS. 5 and 6, is generally similar to the liquid dispensing system 110 illustrated in FIGS. 3 and 4, except as hereinafter described.

The spray nozzle unit 250 has a spray actuator 252, with a valve 254, enclosed within the upper housing portion 222, and operably to dispense the liquid through a hole or slot 229 in the upper housing m portion 222.

An electrical On-Off switch 290 is mounted on the upper housing unit 222 and is operably connected to the electric motor 249 (and batteries 227), as hereinbefore described, and also to a spray actuator motor 291 mounted within the upper housing portion 222, adjacent the liquid nozzle unit 250.

When the switch 290 is switched On, the spray actuator motor 291 depresses the spray actuator 252 to open valve 254 to enable the liquid to be dispense through the hole or slot 229.

The operation of th liquid spray dispensing system 210 is otherwise as hereinbefore described for the liquid spray dispensing system 110 of FIGS. 3 and 4.

The skilled addressee will appreciate that the present invention provides a simple, efficient liquid spray dispensing system, which is suitable for dispensing a wide range of liquids, for different applications, in a wide range of locations.

The skilled addressee will further appreciate that the containers 61, 161, 261 for the liquids 70, 170, 270 to be dispensed, can be easily changed e.g. when a container is exhausted of the liquid, or when an alternative liquid is to be dispensed.

By having rechargeable batteries, the systems can be used remotely from an electrical supply for a period of time; while the provision of a charging base or station enables the batteries to be easily recharged or the system to be used at a fixed location for an indefinite period.

The skilled addressee will further appreciate that the embodiments described and illustrated are by way of examples only; and that various changes and modifications may be made thereto without departing from the scope of the present invention.

The invention claimed is:

1. A liquid spray dispensing system, including:

a housing;

a liquid container, receivable in the housing, operable to contain at least one liquid to be dispensed, and having a liquid storage compartment with at least one flexible or movable wall portion;

a spray nozzle unit at, or adjacent, a first end of the housing, the spray nozzle unit, connectable to the liquid storage compartment, having a spray outlet, the spray nozzle unit including a sensor;

an actuator in the housing, the actuator being operably engageable with the flexible or movable wall portion to reduce the volume of the liquid storage compartment, so as to enable at least a portion of the liquid within the liquid storage compartment to be dispensed through the spray nozzle unit; and an electric motor operably connected to the spray nozzle unit and the actuator, wherein the sensor detects downward movement of the spray nozzle unit and the downward movement causes a signal to be sent to the electric motor to extend the actuator.

2. The dispensing system of claim 1, wherein:

the housing is formed in two or more portions, where a first or lower housing portion is supportable or mountable on a surface; and a second or upper housing portion is detachably-mounted, detachably coupled, hingedly-mounted or movably-mounted to the first or lower housing portion to enable access to at least one compartment to receive the liquid container within the housing.

3. The dispensing system of claim 2, wherein:

the second housing portion is detachably-coupled on the first housing portion via a bayonet-type coupling, a screw-type coupling, a friction-coupling, or other releasable connection.

4. The dispensing system of claim 1, wherein:

the liquid container is substantially cylindrical in configuration, with at least one side wall, a first or upper end wall, and a second or lower end wall; and where a fluid outlet connected to the spray nozzle unit is provided in the first end wall; or the liquid container is substantially spherical; and the fluid outlet is provided in the spherical side wall.

5. The dispensing system of claim 4, wherein:

at least the side wall is formed of flexible material.

6. The dispensing system of claim 4, wherein:

the second end wall, or a portion of the spherical side wall, has a substantially-planar portion to be engaged by the actuator.

7. The dispensing system of claim 4, wherein:

the side wall is substantially rigid; and the second or end wall is slidably, and sealably, received within the side wall and is engaged by the actuator.

8. The dispensing system of claim 4, wherein:

the spray nozzle unit extends through an end wall of second housing portion, and the spray outlet is external to the second housing portion; or the spray nozzle unit is received within the second housing portion, and the spray outlet directs the liquid through a hole or slot in a wall portion of the second housing portion.

9. The dispensing system of claim 1, wherein:

the spray nozzle unit is operable to dispense the liquid while the actuator is in operation; and the spray nozzle unit is a limiting valve which releases the liquid through the outlet when the pressure of the liquid reaches/exceeds a preset limit, or the spray nozzle unit is operated by a spray actuator motor to dispense the liquid while the actuator is in operation.

10. The dispensing system of claim 4, wherein:

the actuator is mounted in the first housing portion and has an actuator plate or piston reciprocally-movable along a path substantially co-axial with a longitudinal axis of the housing, the actuator plate or piston engaging the second end wall or spherical side wall to move that wall towards the spray nozzle unit to reduce the volume of the liquid storage compartment.

11. The dispensing system of claim 10, wherein:

the actuator plate or piston is mounted on a shaft of an electronic worm drive unit; or the actuator or piston is mounted on a rack of a rack-and-pinion drive unit; or the actuator is a linear actuator.

12. The dispensing system of claim 10, wherein:

the actuator is powered by batteries in the first housing portion via a recharging base station fixed to, or releasably detachable from, the first housing portion.

13. The dispensing system of claim 10, wherein:

a constant pressure spring applies a substantially constant pressure force on the actuator plate or piston; or an electric motor connected to the actuator piston is operated by a pressure sensor in, or on, the liquid storage compartment;

to urge the actuator plate or piston into engagement with the liquid storage compartment to at least partially pressurise the liquid before the liquid is dispensed.

14. The dispensing system of claim 12, wherein:

the batteries are rechargeable.

15. The dispensing system of claim 9, wherein:

the limiting valve is a pressure-sensitive or a pressure limiting valve.

16. The dispensing system of claim 6, wherein:

the planar portion is recessed relative to surrounding portion(s) of the second end wall or spherical side wall.

17. The dispensing system of claim 5, wherein:

the flexible material has one or more flex- or fold-lines so that the side wall is of substantially concertina-like configuration.

18. The dispensing system of claim 10, wherein:

the actuator is powered by a mains-electricity supply.

* * * * *